United States Patent [19]

Hope et al.

[11] 4,252,429

[45] Feb. 24, 1981

[54] CURVILINEAR, GEARED TRANSPORT ROLLER SYSTEM

[76] Inventors: Henry F. Hope, 3192 Huntingdon Rd., Huntingdon Valley, Pa. 19006; Stephen F. Hope, 2321 Wyandotte Rd., Willow Grove, Pa. 19090

[21] Appl. No.: 6,548

[22] Filed: Jan. 26, 1979

Related U.S. Application Data

[63] Continuation-in-part of Ser. No. 819,126, Jul. 26, 1977, Pat. No. 4,118,998, which is a continuation-in-part of Ser. No. 780,922, Mar. 24, 1977, which is a continuation-in-part of Ser. No. 737,199, Oct. 29, 1976, Pat. No. 4,079,635, which is a continuation-in-part of Ser. No. 555,961, Mar. 10, 1975, Pat. No. 3,989,176, which is a continuation-in-part of Ser. No. 457,829, Apr. 4, 1974, abandoned, and Ser. No. 513,244, Oct. 9, 1974, Pat. No. 3,952,610.

[51] Int. Cl.[3] ..... G03D 3/13

[52] U.S. Cl. ..... 354/322; 354/328; 226/188; 74/421 R

[58] Field of Search ..... 354/297, 316, 319, 320, 354/321, 322, 324, 328; 226/118, 119, 188, 189; 74/412 R, 413, 414, 421 R; 134/64 P, 122 P; 34/155

[56] References Cited

U.S. PATENT DOCUMENTS

| | | | |
|---|---|---|---|
| 3,078,024 | 2/1963 | Sardeson | 226/189 |
| 3,287,013 | 11/1966 | Fairbanks et al. | 354/319 |
| 3,366,025 | 1/1968 | Layne | 226/189 |
| 3,380,368 | 4/1968 | Snarr | 134/122 |
| 3,435,749 | 4/1969 | Cauwe et al. | 134/122 P |
| 3,608,807 | 9/1971 | Lee | 226/189 |
| 3,656,676 | 4/1972 | Hope et al. | 354/321 |
| 3,747,499 | 7/1973 | Foster | 354/322 |
| 3,752,052 | 8/1973 | Hope et al. | 354/297 |
| 3,760,705 | 9/1973 | Miller | 354/322 |
| 3,769,897 | 11/1973 | Zwettler et al. | 34/155 |
| 3,788,153 | 1/1974 | Lee | 226/189 |
| 3,858,870 | 1/1975 | Yabe et al. | 354/321 |

*Primary Examiner*—L. T. Hix
*Assistant Examiner*—Alan Mathews
*Attorney, Agent, or Firm*—Weiser, Stapler & Spivak

[57] ABSTRACT

A film development machine, having plural film treatment tanks capable of containing fluids therein for the development of a film transported therethrough by plural transport roller racks, which are small in size, capable of use in areas of limited access by permitting the film to be introduced into, and to be delivered from the machine, from the same side, and especially well adapted to develop films which are relatively small in length and width. The roller racks have a plurality of rollers forming an essentially non-linear film travel path between machine inlet and outlet. The rollers are closely spaced so that films of relatively small size can safely and reliably pass therethrough. Close roller spacing is maintained by providing rollers of different diameters, which compensate for the curvature of the path of film travel, and a gear drive system which drives nip forming pairs of rollers from alternating sides of the roller rack. The gear drive system is capable of efficiently driving the increased number of rollers. This system comprises roller drive gears which coaxially rotate each of the rollers, intermediate gears which coaxially rotate roller drive gears, and power gears which serially rotate the intermediate gears, either through direct, meshing engagement or through transfer gears which are in meshing engagement therewith. The power gears of each roller rack are operated from a common drive train, providing a completely geared roller drive system.

13 Claims, 19 Drawing Figures

16
7A
93
96
97
98
99
104
109
114
117
170
171
172
173
174
175
176
177
178
179
180
181
183
184
185
200

CURVILINEAR, GEARED TRANSPORT ROLLER SYSTEM

RELATED CASES

This application is a continuation-in-part of our copending U.S. patent application Ser. No. 819,126, filed July 26, 1977, now U.S. Pat. No. 4,118,998 which is a continuation-in-part of our patent application Ser. No. 780,922, filed Mar. 24, 1977. Our application Ser. No. 780,922 is a continuation-in-part of our patent application Ser. No. 737,199, filed Oct. 29, 1976, now U.S. Pat. No. 4,079,635, issued Mar. 21, 1978, which is in turn a continuation-in-part of our patent application Ser. No. 555,961, filed Mar. 10, 1975, now U.S. Pat. No. 3,989,176, issued Nov. 2, 1976. U.S. Pat. No. 3,989,176 is a continuation-in-part of patent application Ser. No. 457,829, filed Apr. 4, 1974, now abandoned, and Ser. No. 513,244, filed Oct. 9, 1974, now U.S. Pat. No. 3,952,610, issued Apr. 27, 1976.

In the foregoing prior patent applications and now issued patents, there is taught a highly efficient, novel concept for powering racks containing long strings of transport rollers using gears only. In accordance with that concept, each roller is coaxially rotated by its own roller drive gear. These roller drive gears are coaxially driven by respective cluster drive gears, which in turn are rotated by power transmitting gears of larger pitch diameters. Each cluster drive gear taps off from the main flow of power only the fraction of power needed to drive its own roller drive gears and their coaxially driven transport rollers. Close spacing of these rollers is facilitated by driving alternating pairs of rollers from alternating sides of the roller rack.

The present invention involves a still further utilization of this novel concept, in conjunction with other techniques with which it cooperates in a highly advantageous manner. Thus the present invention further demonstrates the broad scope of useful applicability of the above-mentioned concept.

BACKGROUND OF THE INVENTION

This invention relates generally to photographic film development machinery, and in particular to a photographic film development machine which is especially well adapted to developing films which are relatively small in length and width, and which is capable of utilization in areas of limited access.

Machines are known which are capable of transporting a web or strip of film through a series of roller racks which extend into various tanks containing various film treatment baths therein. Such racks are capable of automatically transporting the film being developed through a series of areas for development, drying and subsequent delivery from the machine.

In order to increase the reliability of such machines, the various patent applications and issued patents above described have disclosed roller racks having rollers which are sufficiently close together to safely guide a strip or web of film therethrough, without the film jamming within the transport rack as a result of its failure to properly thread between respective rollers within the rack.

These roller and gear systems have operated satisfactorily in transporting a web of film through the machine both safely and with assured reliability. However, in certain applications, the film being developed is not found in long narrow strips or webs but rather is short and rectangular in shape; possibly even a single frame of relatively small size. One example of such a film would be the dental x-ray, which is ordinarily of a size on the order of one square inch. In developing films of this size there arises problems different from those problems addressed and solved in connection with roller racks which are capable of processing long strips of film.

For example, the small size of the films to be developed makes it more difficult to assure proper threading of the films through the various transport roller racks of the film development machine. Particular care must be taken when the film is to be caused to turn through a given angle of rotation, to either change the direction in which the film is proceeding, or to pass that film from one area of the machine to another.

In addition, unlike the larger web developing machines, having large racks and which are best suited to larger commercial utilization, machines capable of developing smaller films must be able to accommodate potential small scale, private users. For example, in the processing of relatively small x-rays, such as dental x-rays, the potential user would be a laboratory or even a private practitioner. A developing machine which will be useful in such situations must therefore account for the potential environment in which it is to be used.

First, such a machine must be sufficiently small to acceptably fit into the laboratory or office in which it is to be used. Most such facilities cannot afford to have such a machine occupying a significant amount of floor space. It would therefore be preferable to have a film development machine which is capable of resting upon a table top and which is capable of use in areas having limited access space.

Second, such a machine should be sufficiently simple in operation that a person not well skilled in the art of film development can operate the machine and obtain proper results.

Film development machines which have been devised to satisfy the foregoing requirements have been less than satisfactory in their performance. Producing a film development machine which is small in size has required the use of roller racks which have short, shallow paths along which a film is caused to travel, to enable such roller racks to fit into the small film treatment tanks available, rather than the long, linear paths which can be used in larger development machines. Consequently, a film to be developed is able to pass through a given film treatment tank along a significantly shorter path. However, to properly develop a film, it is necessary that it remain within each film treatment tank for a specified period of time to assure complete development. Since this period of time is fixed, previous film development machines have had to process a film through the several roller racks at a slow rate of speed, to compensate for the short length of the path of film travel through each film treatment tank.

Slowing down the rate of speed that a film travels through a series of rollers causes certain problems to arise. First, a film when wet is limp in consistency. Consequently, there arises the potential that a limp film, while being passed from roller to roller, will have sufficient time to curve downwardly, causing that film to leave its prescribed path. Second, a film during the drying process tends to curl, as well as to stick to the rollers as it is passed therethrough. Again the opportunity exists for a film to leave its prescribed path of film travel. In either case, the film being processed would be damaged, if not completely destroyed. Moreover, these problems become even more acute when the films being processed are small in length and width.

In order to reduce this potential for damage to a film, there arises a need for a film development machine which is small in size, yet which is capable of fully developing a film while also processing that film therethrough along a path of film travel which is more conducive to proper film threading.

SUMMARY OF THE INVENTION

This invention relates generally to the field of photographic film development machines, and in particular to a photographic film development machine which is particularly suited to the development of films which are small in length or width, which is capable of being used by persons unskilled in the art of film developing, and which is capable of being used in areas having limited access or size.

A film development machine is provided having a plurality of tanks, each of which contain one of a plurality of film treatment baths, through which a film is transported by a plurality of transport roller racks.

The transport roller racks of the present invention are provided with a series of rollers which differs from those of previous transport roller racks principally in three respects: the path of film travel they form, the closeness of the spacing between adjacent rollers, and the gear system which operates them.

Each roller rack is provided with rollers which form a path of film travel which is deeper than that of previous roller racks. A film is caused to proceed deeper into the film treatment bath contained in each respective film treatment area thereby permitting that film to proceed along a path which remains within that treatment bath for a greater distance. In this manner a film can be moved along the path of film travel at a greater rate of speed than in previous roller racks.

In addition, each roller rack is provided with a plurality of transport rollers which are more closely spaced together than were rollers used in previous roller racks. In this manner, a piece of film is required to travel less of a distance between adjacent rollers, decreasing the possibility that such a film will leave its prescribed path, despite its small size.

By increasing the length of the path a film must travel, the speed of the roller system may be proportionately increased. This, coupled with having adjacent rollers which are more closely spaced together, provides a roller transport system of improved efficiency.

Increasing the length of the path of film travel, while simultaneously decreasing the distance between rollers, necessitates the use of a substantially increased number of rollers in each roller rack. The source of power utilized to drive the several transport roller racks must be configured to accomodate this increased number of rollers as well.

Previously, roller racks have used to a large extent a combination of gears and belts to operate the rollers contained therein. The use of belts had already proved less than satisfactory since such belts tended to break, halting operations, or stretch, requiring some adjustment of the system. These problems were enhanced when the belts used were exposed to the chemical treatment baths contained in the respective film treatment tanks.

Furthermore, the belts previously used sometimes slipped or jumped a cog, causing irregular procession of a film through the rollers, at times marring or damaging the surface of the film being developed.

Each of these problems would of necessity increase as the number of rollers in a given roller rack increases. To enable the close roller spacing called for in the present invention, and to efficiently and reliably operate the increased number of rollers of the present invention, each roller rack is provided with a roller drive system which uses only gears, no belts being necessary, for operation of the several roller racks.

To enable the close roller spacing required, each roller rack is provided with a gear drive system which drives alternating nip forming pairs of rollers from alternating sides of the roller rack. Consequently, the spacing required to accomodate such gears may be reduced, enabling the rollers to be moved closer together.

To drive the increased number of rollers there is provided a gear drive system, in accordance with our above described patent applications and issued patents, which is capable of driving the rollers with assured reliability, smoothness and safety. To this end, each roller is provided with a coaxially connected roller drive gear, nip forming pairs of rollers having roller drive gears which mesh with each other. Pairs of roller drive gears are coaxially driven by intermediate gears which are coaxially connected to one of the pair of roller drive gears. These intermediate gears are caused to rotate by power gears, each intermediate gear tapping off from the power gears only that amount of power required for operation of the rollers with which it is associated. The power gears of each roller rack are all driven by a common, geared, drive train. A smooth and efficient gear drive system results which is capable of properly rotating the increased number of rollers located within the rack at the speeds required for proper development to occur. Such a gear system is provided at both sides of each roller rack to drive the roller drive gears which are located on that side of the rack.

To further enhance the travel of a film along such a roller path, the rollers that comprise the path are of varying size, rollers located on the convex side of a curve in the path being larger than the rollers on the concave side of that path. Such differentiation in size further enhances the reliability of the operation of the machine since larger rollers are placed at locations at which a film could potentially leave its proper path. This increased reliability results by providing a path of film travel wherein the spacing between adjacent rollers along both the concave and convex sides of the curved portions of the path is essentially equivalent.

Since rollers having different diameters will process film through the machine at different rates of speed, the gears which drive such rollers are sized to compensate for the differing roller diameters, so that a film will proceed at a uniform rate of speed along the film guiding path irrespective of the size of the rollers through which it proceeds.

Film development machines are generally provided with four distinct areas or treatment tanks, each of which provides one of the four functions required to develop a film: namely developing, fixing, washing and drying. Each area is provided with a transport roller rack capable of transporting a film therethrough in accordance with the above described inventive technique. However, in accordance with the present invention, the roller racks of those areas of the machine which develop and dry the film, hereinafter referred to as the developer rack and the dryer rack, are particularly configured to enhance the operation of such a machine in areas of limited access.

To this end, the rollers of the developer rack are placed so that the input to that rack, and therefore to the machine, is through its top, rather than at its side as is commonly provided in connection with conventional developer racks. The gear drive system is also accordingly modified.

In addition, the dryer rack is configured so that a film delivered therefrom, after being dried, is also delivered from the machine at its top, rather than its side as is conventionally accomplished, the gear drive system again being modified accordingly. In this manner, the development machine is made capable of accepting and delivering a film from the same side. Therefore, access to the machine need only be maintained along its top, and not along its sides, thereby enabling such a machine to be placed alongside other equipment in close proximity thereto without its operations being interfered with.

Accordingly, it is an object of the present invention to provide a film development machine which is capable of reliably processing films that are small in size.

It is another object of the present invention to provide a film development machine which is capable of operation in areas of limited access.

It is still another object of the present invention to provide a film development machine which is capable of accepting and delivering therefrom a film along the same side of the machine.

It is still another object of the present invention to provide a film development machine which is small in size.

It is still another object of the present invention to provide a film development machine which is capable of operation while placed upon a table top, or similar surface.

It is still another object of the present invention to provide a film development machine which is capable of transporting a film therethrough in a reliable and positive manner.

It is still another object of the present invention to provide a film development machine having a geared roller drive system which is smooth and efficient in operation.

It is still another object of the present invention to provide a film development machine having a geared roller drive system which is smooth and efficient in operation, even though the transport roller racks which comprise the film development machine transport the film along an irregular path.

It is still another object of the present invention to provide a film development machine which is capable of operation by persons lacking special training in the development of film.

These objects and others will become apparent to those skilled in the art from the following disclosure of the preferred embodiment of the invention taken in conjunction with the drawings provided in which like reference characters refer to similar parts throughout the several views provided, in which:

DESCRIPTION OF THE PREFERRED EMBODIMENT OF THE INVENTION

Figures 1, 2:
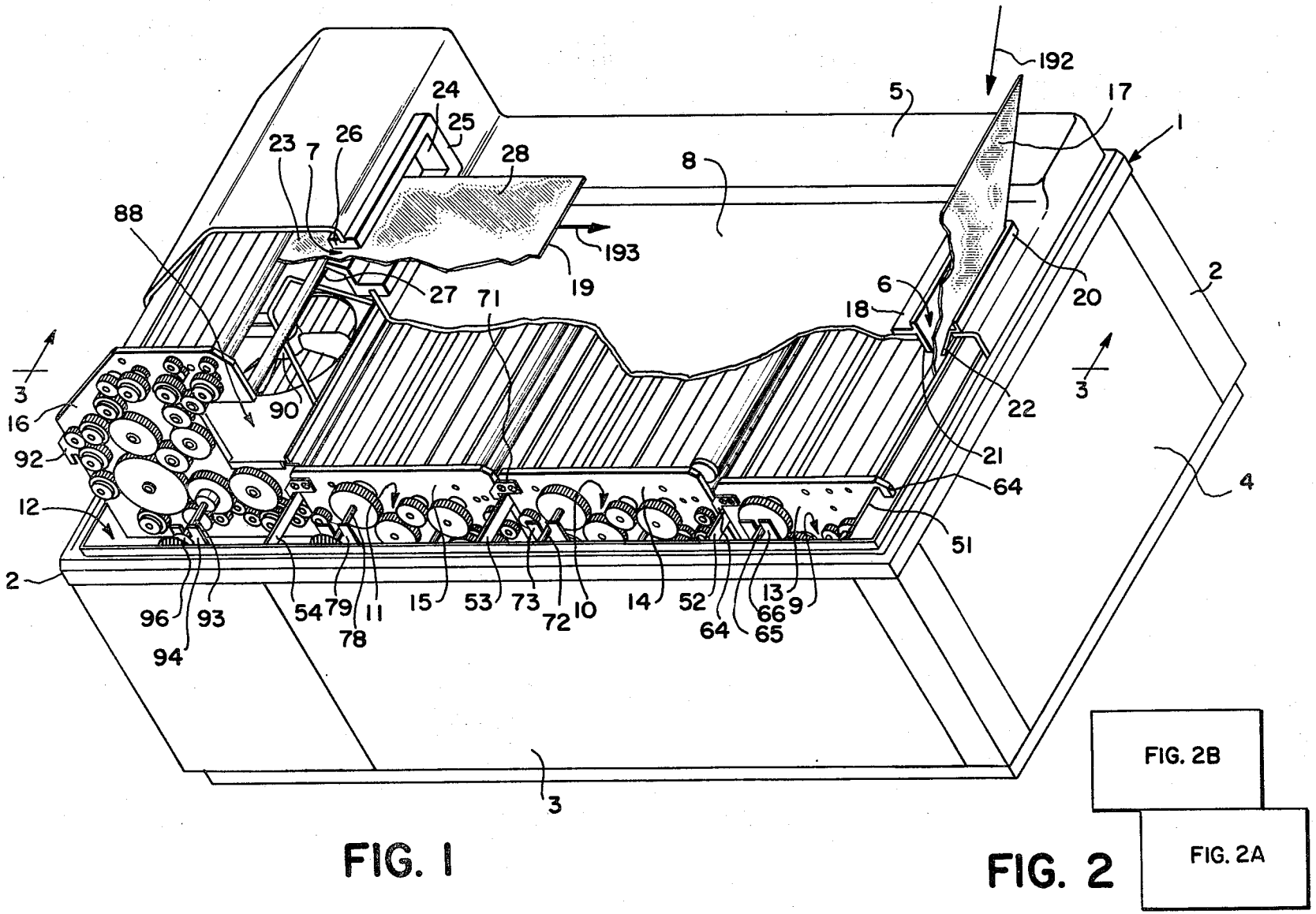
FIG. 1 is an isometric view of the film development machine of the present invention, broken away to show interior construction details.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 a preferred embodiment of the film development machine 1 of the present invention, the outer structure of which generally comprises a support frame 2 having removable sides 3 and removable ends 4 and a top 5 having an inlet 6, outlet 7 and tray 8. Contained within the resulting enclosure are four partitioned areas: the developer area 9, the fix area 10, the wash area 11, and the drying area 12. These areas each contain a transport roller rack therein referred to hereinafter as the developer rack 13, fix rack 14, wash rack 15 and dryer rack 16, respectively.

As illustrated in FIG. 1, a strip of film 17 to be developed is initially inserted downward into the inlet 6 for processing. A strip of film 17 is shown for ease of illustration only. It is to be understood that film development machine 1 is particularly well adapted for use in developing short, small pieces of film, as well as strips of film such as illustrated. Inlet 6 is provided with a guide means 18 which directs the leading edge 19 of the film 17, introduced into the machine 1 in the direction shown in arrow 192, into the interior of the machine 1 and toward the developer rack 13. This guide means 18 comprises a raised rim 20 extending around the perimeter of the inlet 6, and downwardly extending vanes 21, 22 which direct the film toward the developer rack 13. As illustrated, one vane 21 is essentially vertical, acting as a stop which guides the film 17 downward as desired, while the other vane 22 is slightly slanted to facilitate the feeding of the film 17 into the inlet 6. Although preferred, such a shaped inlet 6 is not required for proper operation of the machine 1.

The film 17 is then caused to proceed through the series of roller racks in a manner to be more fully described below, eventually exiting the dryer rack at 23 in FIG. 1. The developed film 28 is then delivered from the outlet 7 of the machine 1, in the direction shown by arrow 193, through a second guide means 24, again preferably comprising a rim 25 and guiding vane 26. Only a lower guiding vane 26 is called for at the outlet 7. The film 17 is then delivered onto the top 5 of the machine 1, preferably into a tray 8 formed as part of the top 5.

From the above it may be seen that all that need be done to develop a film 17 is to insert that film into the inlet 6. The remainder is accomplished automatically by operation of the machine 1. The developed film 28 is then delivered from the outlet 7 into a holding tray 8, to be collected at the convenience of the operator. Accordingly, operation of the machine is simple and straightforward.

Figure 2A:
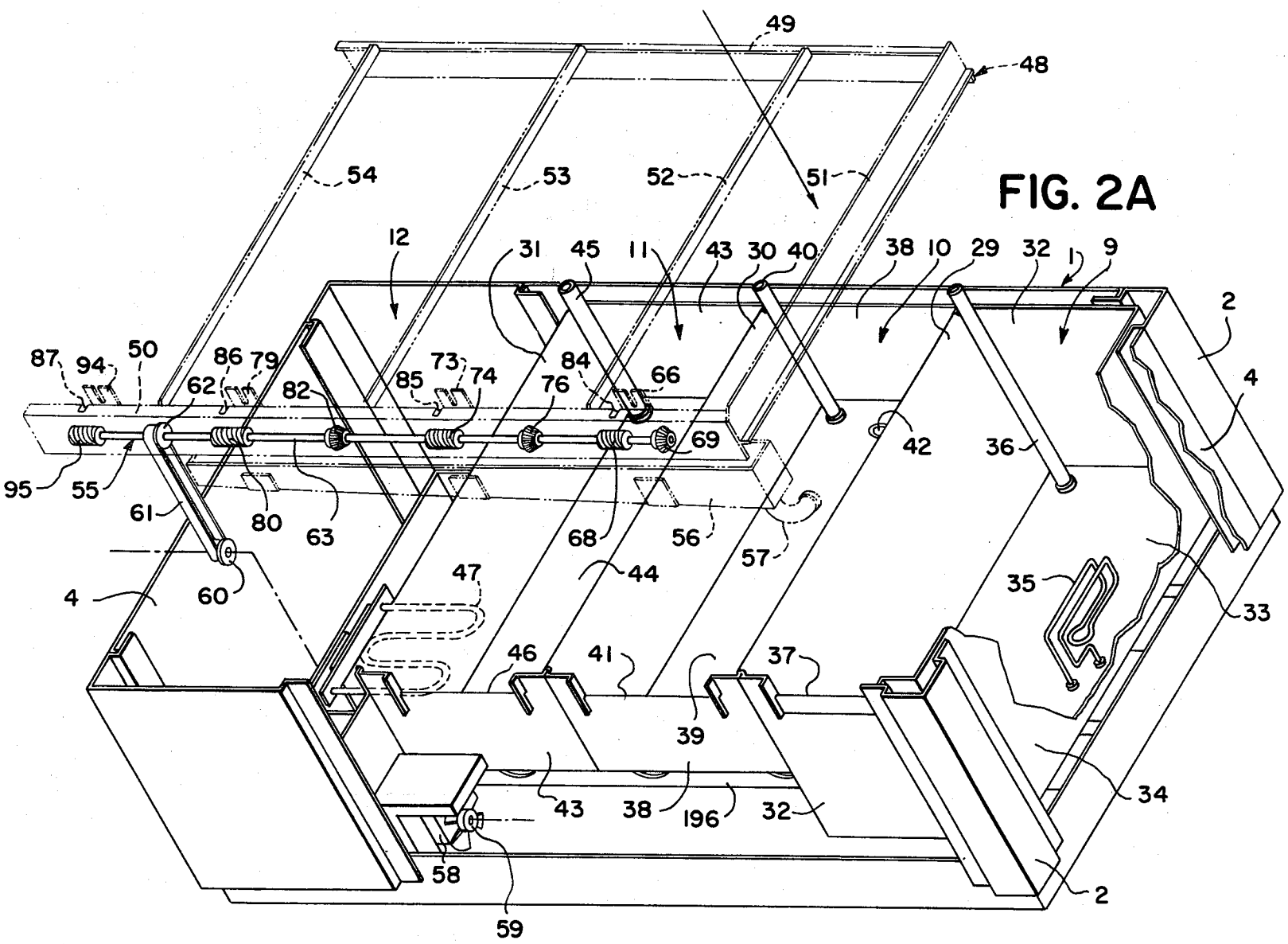
FIG. 2A is an exploded, isometric view of the film development machine with the cover, side panels and transport roller racks removed therefrom, partially broken away to show interior construction details.
Figure 2B:
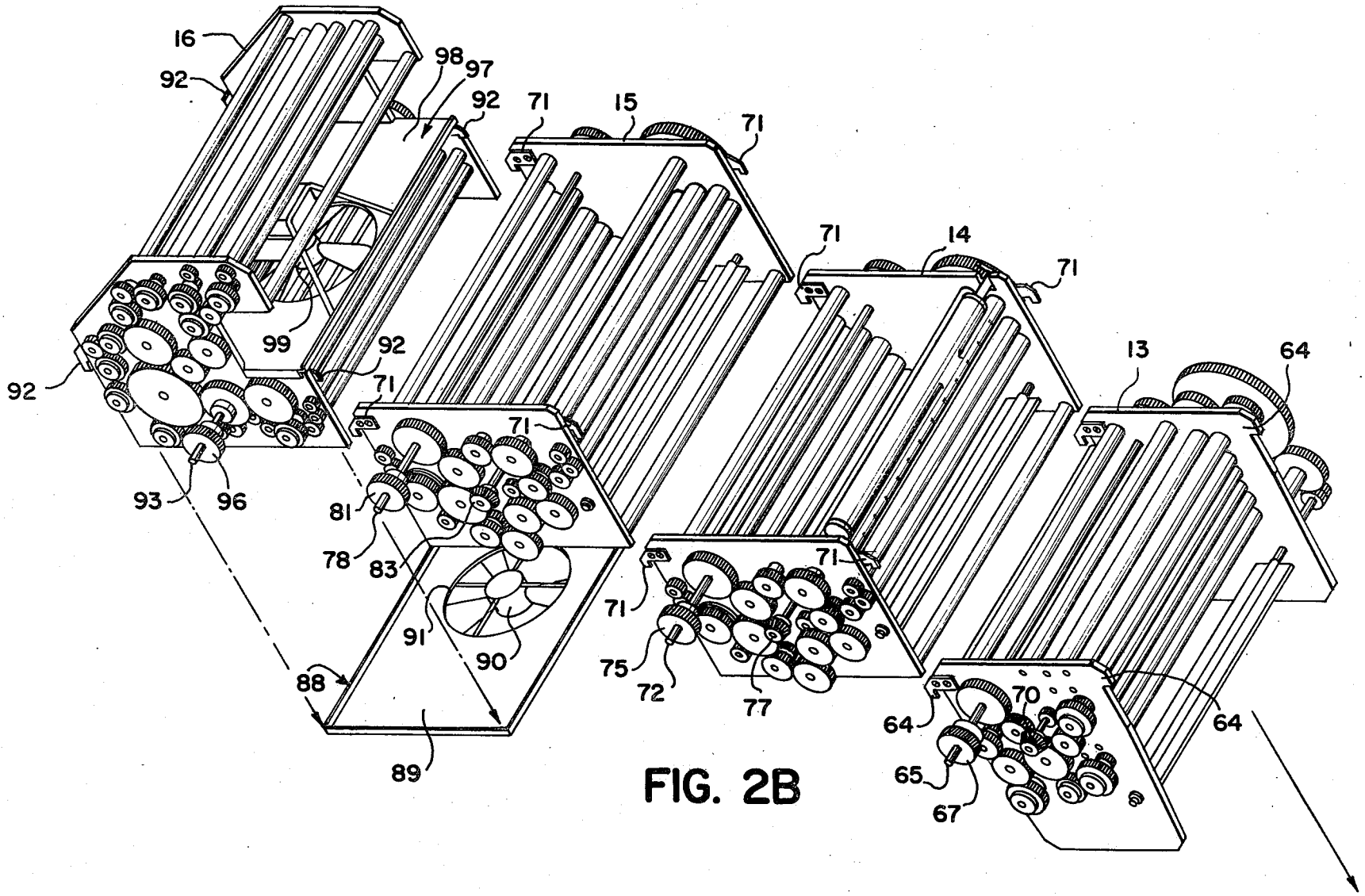
FIG. 2B is an isometric view of the transport roller racks which would fit into the respective film development areas illustrated in FIG. 2A.

Turning now to FIGS. 2A and 2B, the interior construction of the development machine 1 above described will be shown in greater detail.

FIG. 2A shows an exploded view of the main frame 2 of the machine 1, with the sides 3, ends 4, top 5 and transport roller racks 13, 14, 15, 16 removed.

The upper portion of the frame 2 is subdivided into four areas, subdivision being provided by bulkheads 29, 30, 31.

Bulkhead 29 separates the developer area 9 from the fix area 10. The developer area is further defined by side walls 32, floor 33 and wall 34, to define a fluid containing cavity in which is contained a developer solution used in the development process. Also provided in the developer area 9 is a heating element 35, preferably electrically operated, which may be used to regulate the temperature of the developer solution to provide proper development of the film 17 being transported through the developer area 9. The developer area 9 is further provided with fluid handling means 36, 37, standpipe 36 extending upwardly from the floor 33 of the developer area 9, slot 37 being located at the upper edge of the side wall 32 of the developer area 9. Fluid handling means 36, 37 are provided to regulate fluid flow in a manner which maintains adequate levels of a fluid solution within the developer area 9, but which will not permit that fluid to flow over the top of that area 9.

On the opposite side of bulkhead 29 is a fix area 10, defined at its other side by bulkhead 30, and by sides 38 and floor 39. The fix area 10 defines a fluid containing cavity in which is contained a fix solution used in the development process. As in the developer area 9, the fix area 10 is provided with fluid handling means 40, 41 which are used to maintain a proper fluid level in the fix area 10. Also provided in the fix area is an additional opening 42 which may be used for additional fluid handling in the fix area 10 if desired.

Next to the fix area 10 is a wash area 11, defined at each end by the bulkheads 30, 31 respectively, by sides 43 and by floor 44. A wash solution is contained within the wash area 11 and, as previously described, fluid handling means 45, 46 are provided to maintain proper fluid levels in the wash area.

A final, drying area 12 is provided next to the wash area 11, the drying area 12 being defined by the bulkhead 31, the frame 2 of the machine 1 and one of the ends 5 of the machine 1. The drying area 12 is larger than the other areas 9, 10, 11, extending fully to the bottom of the machine 1. Within that drying area 12 is placed a heating element 47 which is used to warm the air flow created within the drying area in a manner to be described below.

Connected to the side portions of the frame 2 is a support frame assembly 48. This assembly comprises a pair of support members 49, 50 and a plurality of cross bars 51, 52, 53, 54. The support member 49 is connected to one side of the frame 2, acting as a support for the cross bars 51, 52, 53, 54. The support member 50 is connected to the other side of the frame 2, acting as a support for the cross bars 51, 52, 53, 54, and as a support for the power train 55 illustrated, the details of which will be described below.

Provided as part of the support member 50 is a drain 56, connected beneath the support member 50. The drain 56 is beveled, in this illustration the drain 56 becoming deeper as it proceeds from left to right. At the deepest end of the drain 56 there is located an outlet 57. The drain 56 is positioned along the near side 3 of the machine 1, in communication with the slots 37, 41, 46 of the respective film treatment areas 9, 10, 11. In this manner, a fluid overflowing from any one of the film treatment areas 9, 10, 11 is directed out from the slot 37, 41, 46 and into the drain 56 for delivery through the outlet 57 to be disposed of externally.

The lower portion of the machine 1, located beneath the areas 9, 10, 11, 12, is provided to accommodate fluid handling means, such as outlets, tubing and drains, and the electrical wiring required to operate the heating coils 35, 47 and other electrical equipment. Located within this area are support frame members 196 which extend longitudinally through the lower area of the machine 1 and which serve as mounting supports for the structure defining the various areas 9, 10, 11, 12.

Also provided in the lower portion of the machine 1 is a motor 58 which is used to drive the power train 55. Motor 58 may be any conventional electric motor, and may be provided with a fan 59 for cooling purposes if desired. The shaft of the motor 58 is provided with pulley 60 which, through belt 61, drives the pulley 62 coaxially connected to the shaft 63 of the drive train 55, thereby causing the shaft 63 to rotate in response to operation of the electric motor 58, to provide power to the transport roller racks 13, 14, 15, 16 for their operation.

The relationship between the frame 2 of FIG. 2A and the roller racks 13, 14, 15, 16 of FIG. 2B will now be described.

The developer rack 13 is located within the developer area 9 as illustrated in FIG. 1. Support for the rack 13 is provided by support hooks 64 which engage the cross bars 51, 52. In this manner the rack 13 is caused to extend downward into the developer area 9 for a distance regulated by the position of the support hooks 64. When in position, the power input shaft 65 of the developer rack 13 is engaged by a notch 66 extending upward from the support member 50. The outermost end of the power input shaft 65 is allowed to pass through opening 84 for ease of installation and removal of the rack 13. The power input gear 67 is engaged by the worm gear 68 to transmit power from the power train 55 to the rollers of the developer rack 13. A second, bevelled gear 70, which extends outward from the developer rack 13, is also engaged by a bevelled gear 69 connected to the power train 55, to transmit power from the power train 55 to a stirring assembly, the details of which will be more fully described below, which comprises part of the rack 13.

The fix rack 14 is located within the fix area 10 as illustrated in FIG. 1. Support for the rack 14 is provided by support hooks 71 which engage the cross bars 52, 53, permitting the rack 14 to extend downward into the fix area 10 for a predetermined distance. As with the developer rack 13, a power input shaft 72 is provided which rests within a notch 73 connected to the support member 50, opening 85 being provided to accept the outermost end of the power input shaft 72. Power for the rollers of the fix rack 14 is transmitted from the drive train 55 to the power input shaft 72 by gears 74, 75, worm gear 74 engaging power input gear 75. Power for the stirring assembly of the rack 14 is transmitted from the power train 55 to the stirring assembly through bevelled gear pair 76, 77.

The wash rack 15 is located within the wash area 11 as illustrated in FIG. 1. Support for the rack 15 is again provided by support hooks 71 which engage cross bars 53, 54, the rack 15 extending downward into the wash area 11 accordingly. Rack 15 again is provided with a power input shaft 78 which engages notch 79 connected to the support member 50. Again, opening 86 is provided to accept the outermost tip of the power input shaft 78. Power for the rollers of the wash rack 15 is transmitted from the power train 55 to the power input shaft 78 by gears 80, 81, worm gear 80 engaging power input gear 81. Power for the stirring system of the wash rack 15 is transmitted from the power train 55 to the stirring assembly through bevelled gear pair 82, 83.

Figure 3:
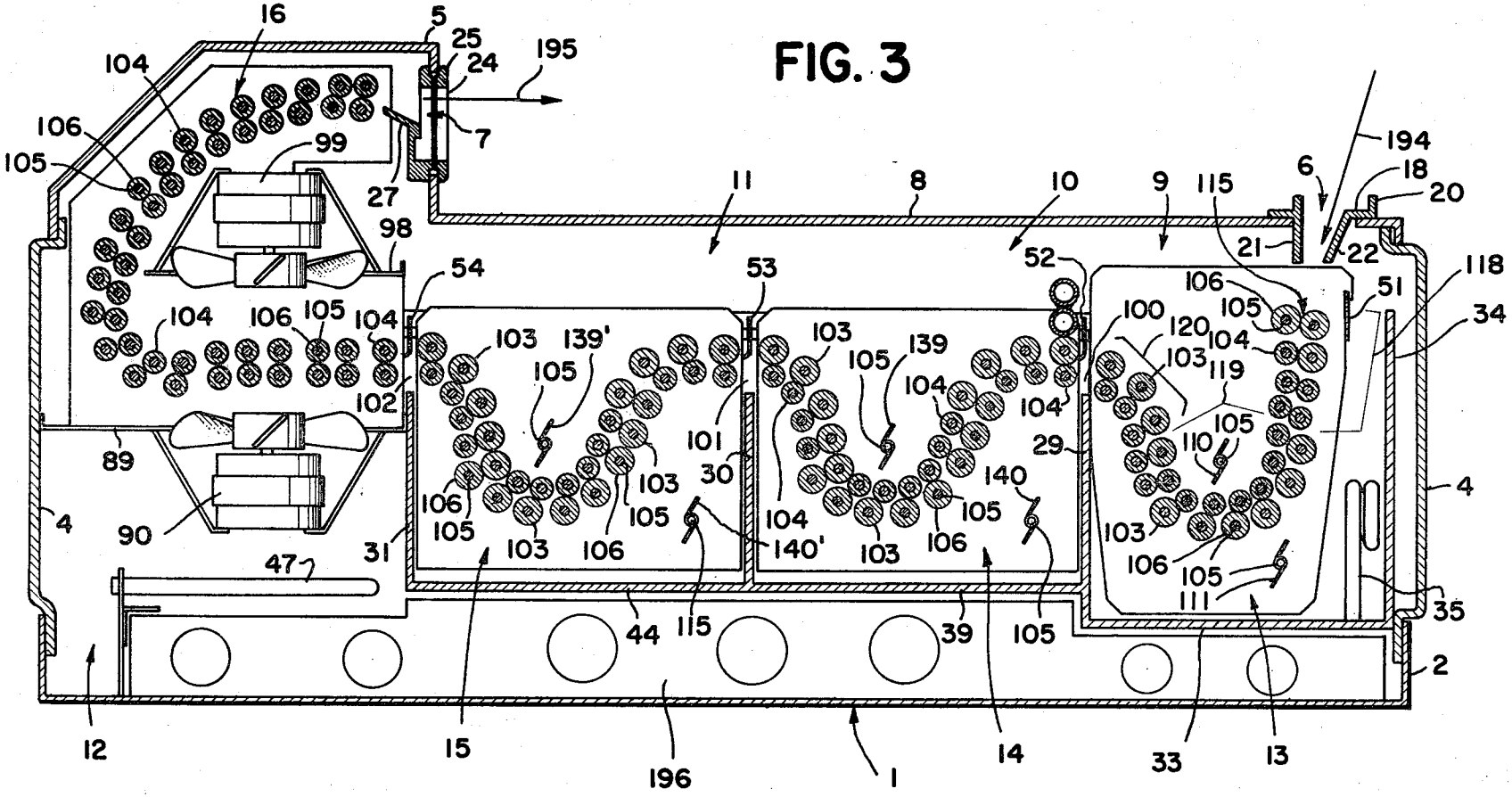
FIG. 3 is a cross sectional view of the film development machine taken along line 3—3 of FIG. 1.

The dryer rack 16 is located within, and above, the drying area 12. A lower fan assembly 88, comprising a support frame 89 and fan 90, is fixedly connected between the bulkhead 31 and the end 4 of the machine 1, as is best seen in FIG. 3, at a point approximately centrally located in height along the end 4 of the machine 1. Beneath the lower fan assembly 88 is the heating coil 47. Thus, air directed up through the opening 91 within the support frame 89, is heated, for direction toward a film 17 proceeding through the dryer rack 16. The dryer rack 16 is supported within the drying area 12, along its bottom by the lower fan assembly 88, and along the edge adjacent to the wash area 11 by support hooks 92 which engage the crossbar 54. In this manner, the dryer rack 16 is supported over the drying area 12, extending above the plane defined by the tops of the racks 13, 14, 15. When in position, the power input shaft 93 of the dryer rack 16 engages a notch 94 connected to the support member 50, the outermost end of the shaft 93 being passed through the opening 87 provided. Power for the rollers of the dryer rack 16 is transmitted from the power train 55 to the power input shaft 93 by gears 95, 96, worm gear 95 engaging power input gear 96.

Dryer rack 16 is also provided with a second, upper fan assembly 97, again comprising a support frame 98 and fan 99. The upper fan assembly 97 is located substantially centrally within the dryer rack 16, as is best seen in FIG. 3. The support frame 98 is connected between the sides of the dryer rack 16, the fan 99 serving to direct air onto the top portions of a film 17 being transported through the dryer rack 16. Such air is heated by the heating coil 47 located within the drying area 12.

FIG. 3 illustrates the path along which a film 17 is guided as it proceeds through the various areas of the machine 1 above described. A film 17 is introduced downward, in the direction of arrow 194, into guide means 18 and into the roller system of the developer rack 13. The film 17 is then passed through the developer solution contained within the developer area 9, and out of the area 9, through the passage 100 located between bulkhead 29 and cross bar 52, toward the fix area 10. Film 17 is then introduced into the fix rack 14, passed through the fix solution contained within the fix area 10, and out of the fix area 10, through the passage 101 defined between bulkhead 30 and cross bar 53, toward the wash area 11. Next, film 17 is introduced into the wash rack 15, passed through the wash solution contained within the wash area 11, and out of the wash area 11, through the passage 102 defined between the bulkhead 31 and cross bar 54, toward the drying area 12. Finally, the film is introduced into the dryer rack 16, which is substantially raised from the other racks 13, 14, 15. The film 17 enters the dryer rack 16 along a path which lies in a plane substantially parallel to the plane defined by the point of exit of the film 17 from the wash rack 15. The film 17 is then passed between the fan assemblies 88, 97, where it is dried by heated air caused to impinge upon the surfaces of the film 17, through the turnabout region 173 of the dryer rack 16, for delivery through the guide means 24 to the exterior of the machine 1, in the direction shown by arrow 195. In this manner a film 17 is developed automatically, being returned to the operator of the machine 1 from an outlet 7 which is on the same side of the machine 1 as was the inlet 6, in this case both being located on the top 5 of the machine 1.

It will be noted that the film guidance path illustrated is essentially non-linear along its entire length. Due to the small size of the machine 1 there is not a sufficient amount of room to utilize the long piecewise-linear roller guidance paths used in larger roller racks. It is also for this reason that rollers 103, 104 of non-uniform diameter are used, to assure the proper threading and transport of a film 17 along the path illustrated.

Having described the overall structure of the machine 1, the construction of the individual roller racks 13, 14, 15, 16 which transport a film 17 through the various portions of the machine 1 will now be described.

In describing each of the several roller racks 13, 14, 15, 16 the following numbering pattern will be utilized. Each of the roller racks 13, 14, 15, 16 generally comprise a series of rollers 103, 104, each roller 103, 104 comprising a centrally disposed, longitudinal extending, preferably metallic, shaft 105, around which is placed a resilient covering 106 which may be rubber, a plastic, or some other material which would suitably interact with the surface of a film 17 with which it contacts. The rollers 103, 104 may be seen to be of two sizes. The larger rollers will be designated as rollers 103, the smaller rollers as rollers 104.

Each roller 103, 104 has placed at one end of its shaft 105 a roller drive gear 107, 117. In a manner to be more fully described below, roller drive gears 107, 117 are coaxially rotated by a first group of gears 108, 109, which will hereinafter be referred to as intermediate gears 108, 109, since they are positioned intermediate roller drive gears 107, 117 and the power gears associated with a given rack 13, 14, 15, 16.

Since rollers 103, 104 are of different diameters, the rollers 103 would tend to move a film 17 along its path at a greater rate of speed than would rollers 104. Consequently, roller drive gears 107, 117 are of two different pitch diameters, roller drive gears 107, which drive larger diameter rollers 103, being larger it pitch diameter than roller drive gears 117, which drive smaller diameter rollers 104. In this manner, a nip forming pair of rollers comprising one large roller 103 and one small roller 104 will move a film along its film guidance path at a uniform rate of speed, avoiding damage to the film, especially the more delicate emulsion side of the film 17.

In addition, intermediate gears 108, 109 are of two different pitch diameters, intermediate gears 108 having greater pitch diameters than intermediate gears 109. By driving roller drive gears 107 through intermediate gears 108, and by driving roller drive gears 117 through intermediate gears 109, a film 17 is caused to proceed at a uniform rate of speed since the rollers 103, 104 are caused to rotate at equal surface speeds.

Intermediate gears 108, 109 are generally serially operated by a system of power gears as follows. Each roller rack 13, 14, 15, 16 is provided with a power input gear, designated as 67, 75, 81, 96, respectively, which derives power from the common drive train 55. Each power input gear 67, 75, 81, 96 transmits power to its respective roller rack, through power input shafts 65, 72, 78, 93, to the power gears 123, 128, 158, 161, 158', 161', 179, 185 associated with the roller rack. These power gears transmit power to a second group of gears, which will hereinafter be referred to as central power gears, which gears operate, directly or indirectly, each of the intermediate gears 108, 109 located on the side of the roller rack with which that central power gear is associated.

Various types of transfer gears are used to transfer power from the power gears to the rollers 103, 104 as follows. Power transfer gears are those gears which transfer power from a power gear to a central power gear. Transfer gears are those gears which transfer power from the central power gear to an intermediate gear 108, 109. Intermediate transfer gears are those gears which transfer power from an intermediate gear 108, 109 to another intermediate gear 108, 109. Roller transfer gears are those gears which transfer power from one roller drive gear 107, 117 to another roller drive gear 107, 117. Other details of the roller and gear drive system will be described below.

Figures 4, 4A:
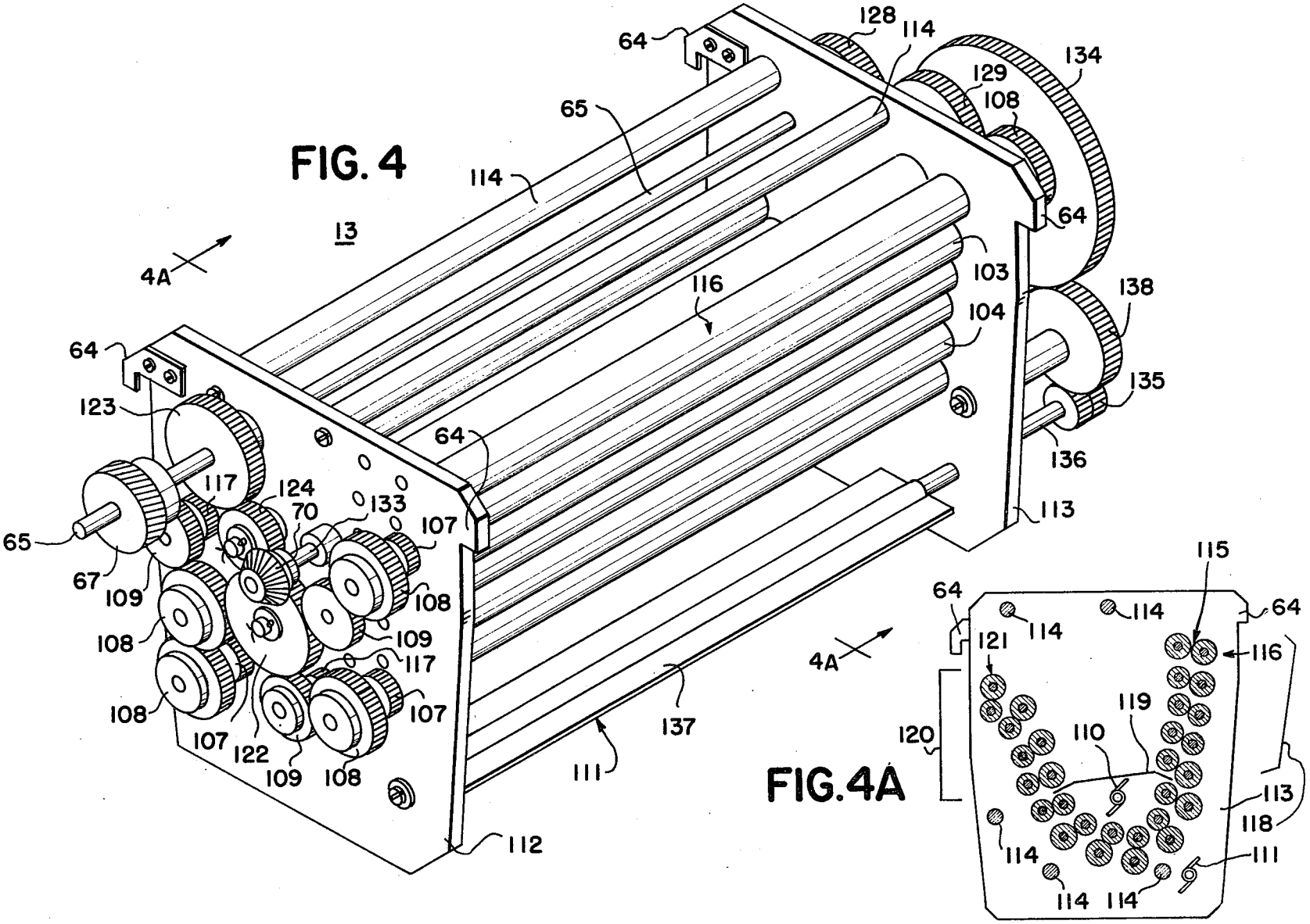
FIG. 4 is an enlarged isometric view of the developer rack illustrated in FIG. 2B.
FIG. 4A is a cross sectional view of the developer rack taken along line 4A—4A of FIG. 4.
Figure 4B:
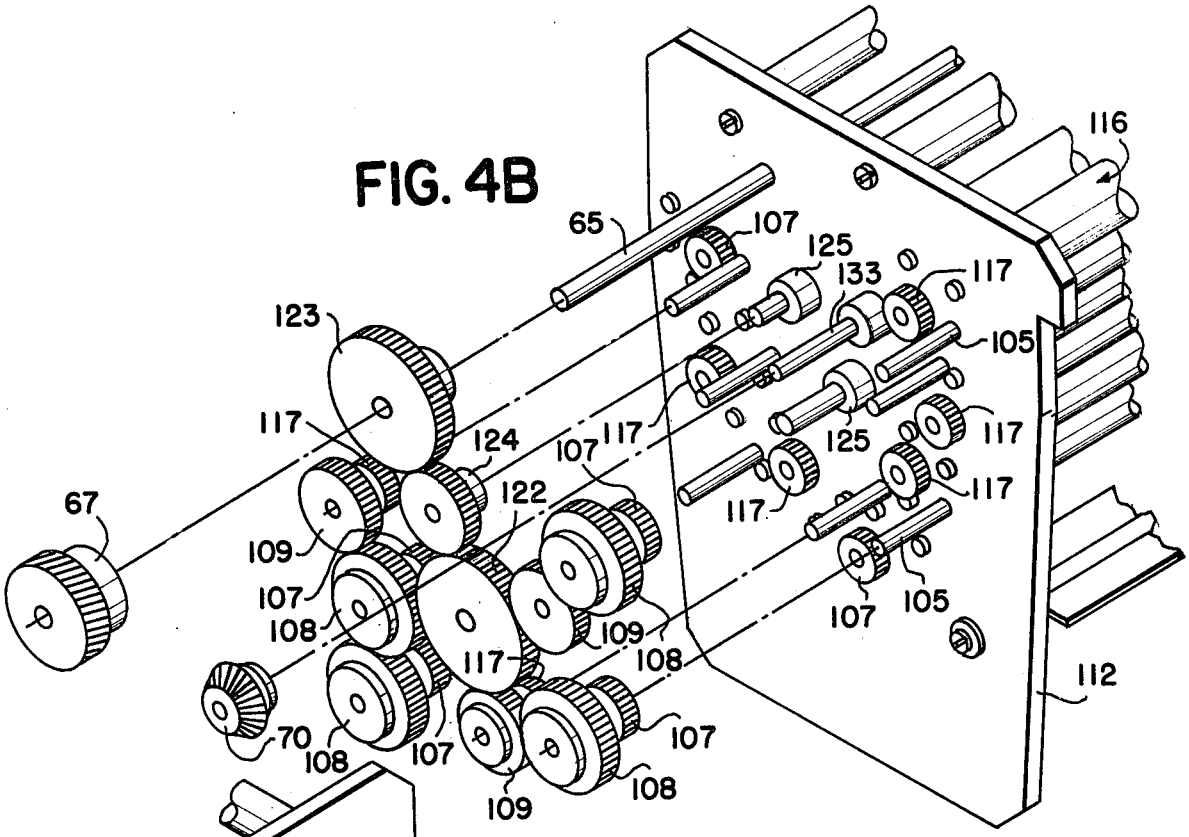
FIG. 4B is an exploded, partial isometric view of the gear drive assembly of the drive side of the developer rack.
Figure 4C:
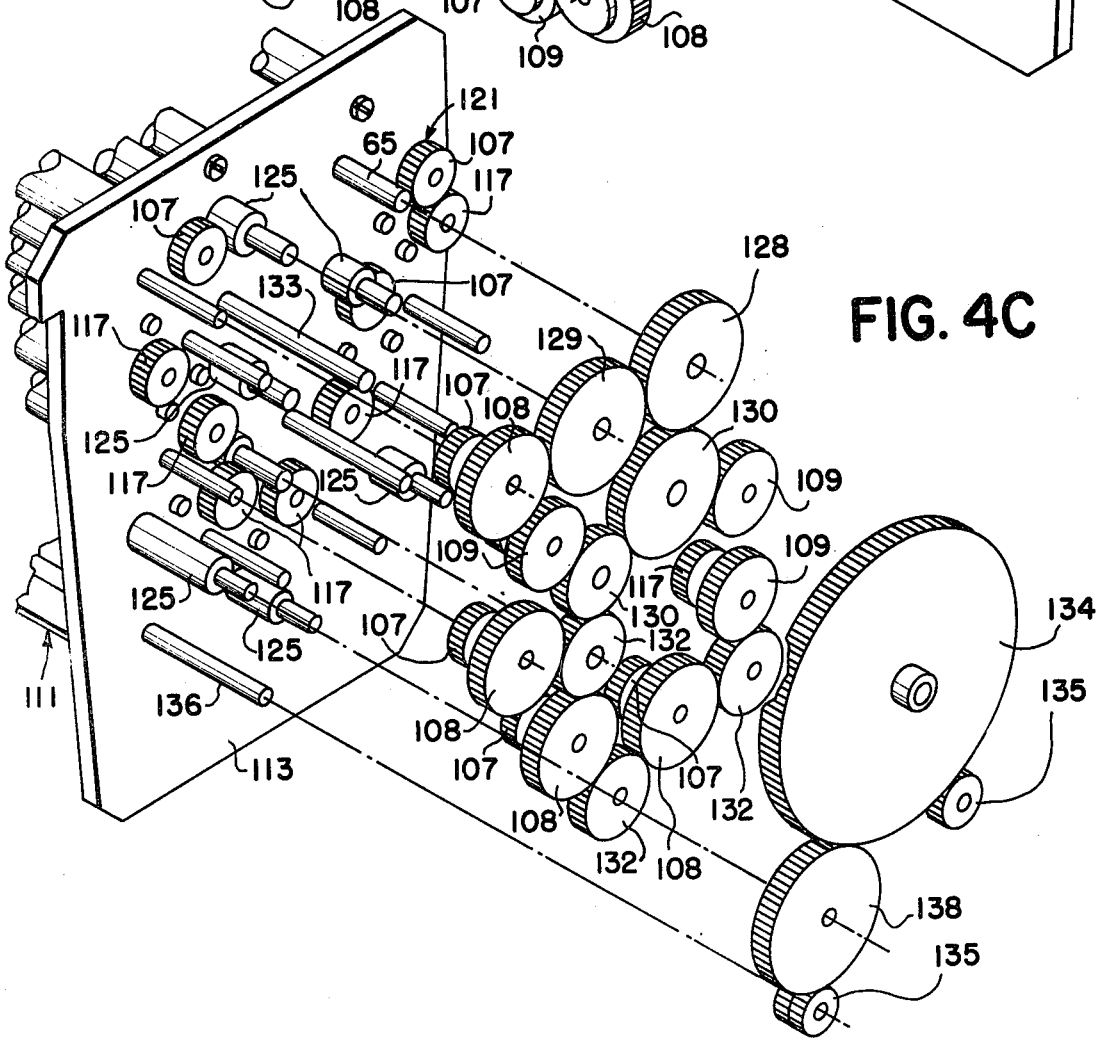
FIG. 4C is an exploded, partial isometric view of the gear drive assembly of the drain side of the developer rack.

FIG. 4 shows the developer rack 13 which is used to transport a film 17 through the developer area 9 of the machine 1. FIGS. 4A, 4B and 4C show construction details of the developer rack 13.

The developer rack 13 generally comprises a series of rollers 103, 104, and a pair of stirrers 110, 111, all of which extend between and through support frames 112, 113, and all of which have shafts 105 which are journalled for rotation within the frames 112, 113. Also extending between frames 112, 113 are a plurality of dowels 114 which are fixedly connected between the respective frames 112, 113 to provide support to the roller rack 13.

FIG. 4A illustrates the path along which a film 17 is directed as it proceeds through the developer rack 13. A film 17, upon introduction into the film guide means 18, is directed downward into a nip 115 defined between a first pair of rollers 103 located at 116. From that first pair of rollers 103, the film 17 is guided through nips formed by successive pairs of rollers 103, 104 as illustrated, first downward through a descending region 118, to a turnabout section 119, then upward through a transfer section 120, finally exiting the rack 13 through a last pair of rollers 103, 104 located at 121.

In each case the spacing between respective pairs of rollers 103, 104 is maintained at a distance less than that of conventional transport roller systems. To this end, rollers 103, 104 are positioned so that larger rollers 103 generally appear along the convex side of a curve, while smaller rollers 104 generally appear along the concave side of a curve. In this manner close roller spacing may be maintained, even along a curved path such as that illustrated in FIG. 4A. Such close roller spacing is similarly provided in connection with the fix rack 14 and wash rack 15, as illustrated.

The gear drive system, illustrated in FIGS. 4B and 4C, which is used to operate the rollers 103, 104 of the developer rack 13, will now be described in greater detail.

Hereinafter, when describing the respective sides of the several roller racks 13, 14, 15, 16, that side of a rack which is adjacent to the power train 55 and which receives power directly therefrom will be referred to as the drive side of the rack. The remaining side, adjacent to support member 49, will be referred to as the drain side of the rack.

Each roller 103, 104 has coaxially connected to one end of its shaft 105 a roller drive gear 107, 117. The gears 107, 117 which driven nip forming pairs of rollers 103, 104 are positioned to mesh with each other, causing the pair of rollers 103, 104 to both rotate in the direction of film travel. To enable adjacent pairs of rollers 103, 104 to be closely spaced together, alternating pairs of rollers 103, 104 are driven by roller drive gears 107, 117 located on alternating sides of the developer rack 13.

Pairs of nip forming rollers 103, 104 are driven by intermediate gears 108, 109 which coaxially rotate one gear of each pair of gears 107, 117, thereby rotating the pair of rollers 103, 104. Intermediate gears 108, 109 are positioned to mesh with each other to form groups of intermediate gears 108, 109, each group of intermediate gears 108, 109 being driven by a central power gear 122.

As illustrated in FIG. 4B, the drive side of the developer rack 13 has three groups of intermediate gears 108, 109; a first group of gears 108, 109 driving rollers 103, 104 in the descending region 118; a second group of gears 108, 109 driving rollers 103, 104 in the turnabout section 119; and the third group of gears 108, 109 driving rollers 103, 104 in the transfer section 120 of the rack 13. Each group of intermediate gears 108, 109 is in mesh with the central power gear 122, each group of intermediate gears 108, 109 tapping off from that central power gear 122 only that amount of power required to drive that group of intermediate gears 108, 109 and the rollers 103, 104 associated therewith.

The central power gear 122 derives its power from the power train 55 through a series of gears as follows. Power input gear 67 receivers power from the power train 55 through worm gear 68. Power input gear 67 rotates the power input shaft 65 which in turn rotates a coaxially rotating power gear 123. Power gear 123 then transfers power to the central power gear 122 through power transfer gear 124.

With the exception of gears 122, 124, each gear is axially connected to a rotating shaft, either the shaft 105 of a roller 103, 104, or the power input shaft 65. Gears 122, 124 are retained in position by studs 125 which are affixed to the drive side frame 112, as illustrated in FIG. 4B, and which permit rotation of the gear 122, 124 affixed thereto by a cotter pin or other similar affixing means.

The power input shaft 65 also extends through the developer rack 13 to operate the gear system of the drain side of the developer rack 13, as illustrated in FIG. 4C. Axially connected to power shaft 65 is a power gear 128 which acts as a central power gear to transfer power to groups of intermediate gears 108, 109 located on the drain side of the developer rack 13. An intermediate gear 108 which drives the first pair of rollers 103 at 116 receives power from the central power gear 128 through a first transfer gear 129. Second transfer gears 130 deliver power from central power gear 128 to a group of intermediate gears 108, 109, associated with the descending region 118 and turnabout section 119, which are also driven through intermediate transfer gears 132, in addition to an intermediate gear 109 which drives the rollers 103, 104 to the transfer section 120 of the developer rack 13.

As on the drive side of the rack, the intermediate gears 108, 109 are axially mounted on the ends of the shafts 105 of rollers 103, 104, thereby serving to coaxially rotate the roller drive gear 107, 117 associated with that roller 103, 104. However the transfer gears 129, 130, 131 associated with the central power gear 128, as well as the transfer gears 132 associated with the drain side group of intermediate gears 108, 109, are mounted on studs 125 affixed to the drain side frame 113 of the developer rack 13, which permit rotation of the gear affixed thereto.

The foregoing describes the gear system used to drive the rollers 103, 104 of the developer rack 13. There is also provided as part of the developer rack 13 a stirring system, comprising a pair of stirrers 110, 111 driven through a series of gears as follows. Power is derived from the drive train 55 through a pair of meshing bevelled gears 69, 70. Bevelled gear 70 is axially connected to a stirrer power shaft 133 which extends through the frames 112, 113 to the drain side of the rack 13, the stirrer shaft 133 being journalled for rotation within the frames 112, 113. Connected to the stirrer shaft 133 at the drain side of the developer rack 13 is a stirrer power gear 134. Stirrer power gear 134 meshes with stirrer drive gear 135 which is axially connected to the shaft 136 of a stirrer 110 located approximately centrally within the developer rack 13. Also in mesh with stirrer power gear 134 is a stirrer transfer gear 138 which rotates a second stirrer 111, located at the bottom left of the drain side of the developer rack 13, through a stirrer drive gear 135 axially connected to the shaft 136 of the stirrer 111. Stirrers 110, 111 are each provided with vaned stirring means 137 which, when rotated, serve to create and maintain a flow within the fluid contained within the developer area 7. Stirrers 110, 111 are driven by a separate gear drive system, forming a third level of gears, so that stirrers 110, 111 may be rotated at a speed different from that of the rollers 103, 104, if desired.

Figures 5, 5A:
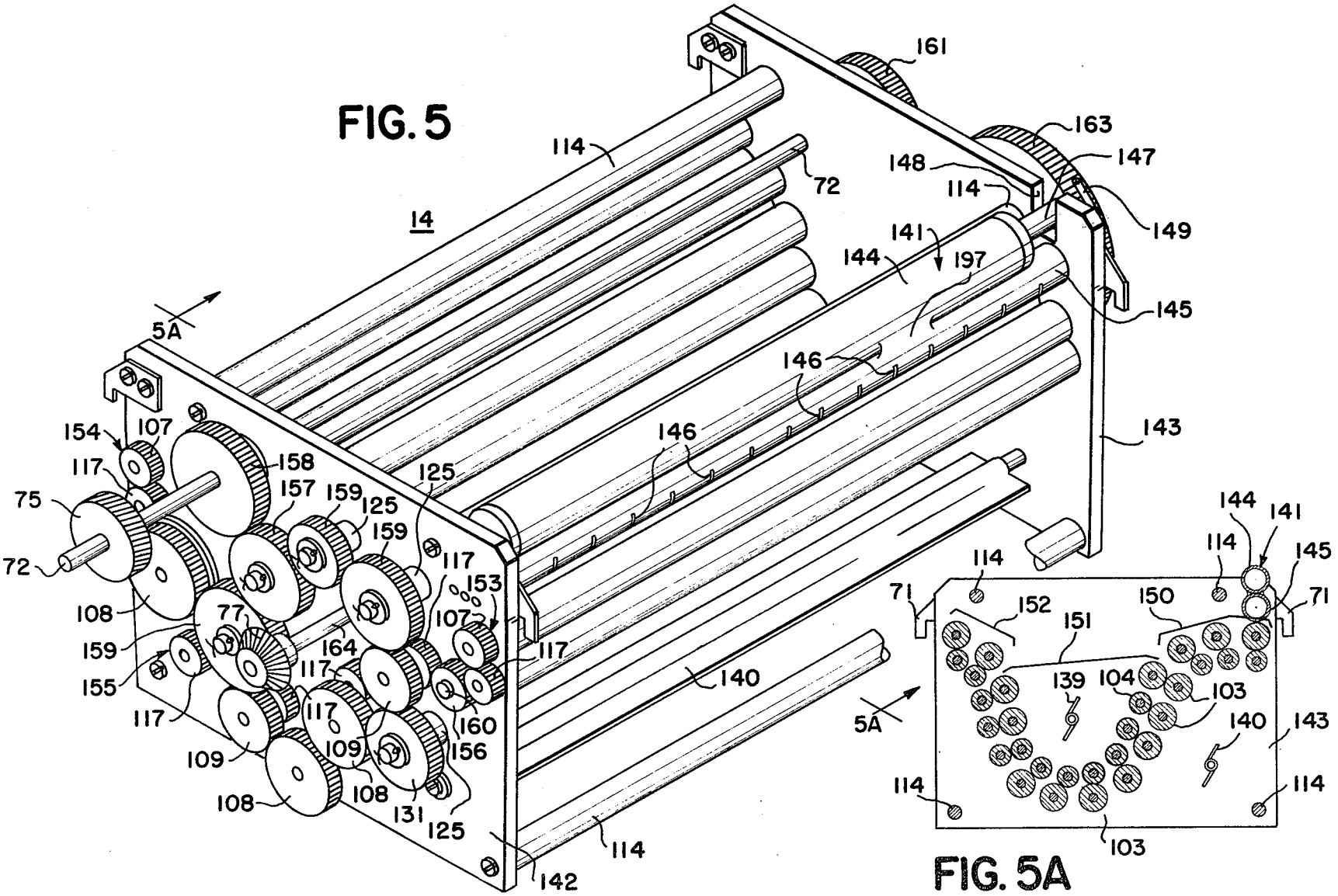
FIG. 5 is an enlarged isometric view of the fix rack illustrated in FIG. 2B.
FIG. 5A is a cross sectional view of the fix rack taken along line 5A—5A of FIG. 5.

FIG. 5 shows the fix rack 14 which is used to transport a film 17 through the fix area 10 after it is received from the developer rack 13 as previously described. FIGS. 4A, 4B and 4C show construction details of this rack.

The fix rack 14 generally comprises a plurality of rollers 103, 104, a pair of stirrers 139, 140 and, preferably, a fluid manifold 141, all of which extend between a pair of frames 142, 143 which define the drive side and drain side of the fix rack 14 respectively. As in the developer rack 13, each roller 103, 104 and stirrer 139, 140 of the fix rack 14 has a shaft 105 extending through, and journalled for rotation within, frames 142, 143. Also extending between frames 142, 143 are dowels 114 which are connected to and between frames 142, 143 to provide support to the rack structure.

Extending between frames 142, 143 is a fluid manifold 141 which is used to deliver a fluid bath, drawn from the fix bath or solution placed within the fix area 10 of the machine 1, over the top of a film 17 as it enters the fix area 10. Manifold 141 comprises a pair of tubular members 144, 145; an upper tubular member 144 capable of receiving the fix solution and which, through a passage 197 which communicates between the members 144, 145, delivers such fluid to a lower member 145; and a lower tubular member 145 capable of distributing that fluid over top of a film 17 passing beneath the manifold 141 through a series of slots 146 provided in member 145. Fluid is delivered to the upper member 144 through a bubble tube 147 extending upward from the bottom of the fix rack 14, through an opening 148 in the fix rack, and into one end of the member 144. An air tube 149 is inserted into the bubble tube 147 at a point near the base of the tube 147. The air tube 149 is connected to an air pump (not shown) which delivers bubbles of air, through the air tube 149, into the bubble tube 147. These bubbles of air rise, creating a partial pressure within the bubble tube 147. In this manner, fluid is caused to follow the air bubbles upward, thereby delivering the fluid to the member 144.

FIG. 5A illustrates the path along which a film 17 is directed as it proceeds through the fix rack 14. A film 17 is introduced into the fix rack at region 150 whereupon it is directed downward into the fluid contained within the fix area 10, along region 151. The film 17 is then delivered from the fix rack 14 by the rollers 103, 104 of the region 152, which transfer the film 17 to the next area of the machine 1.

The gear drive system which drives the above mentioned series of rollers 103, 104, illustrated in FIGS. 5B and 5C, will now be described in greater detail.

As previously described in conjunction with the developer rack 13, nip forming pairs of rollers 103, 104 are caused to rotate in the direction of film travel by pairs of roller drive gears 107, 117 which mesh with each other, and which are axially mounted at the end of the shafts 105 of the rollers 103, 104. Alternating pairs of rollers 103, 104 are driven by roller drive gear pairs 107, 117 which are located at opposite sides of the fix rack 14. Pairs of roller drive gears are driven by intermediate gears 108, 109 which are coaxially connected to one gear of the pair of roller drive gears 107, 117. These intermediate gears 108, 109 are positioned to mesh to form groups of intermediate gears 108, 109, which are each in turn driven by power drive gears as follows.

Figure 5B:
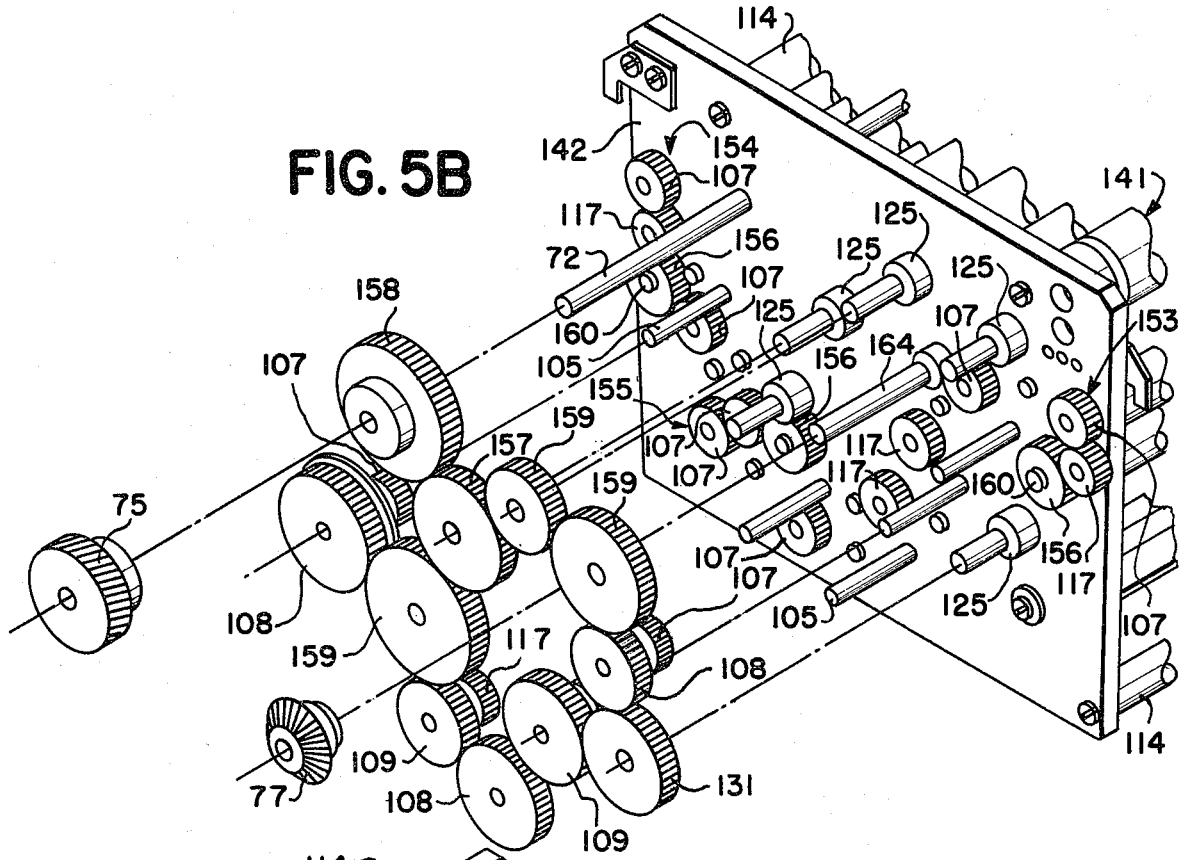
FIG. 5B is an exploded, partial isometric view of the gear drive assembly of the drive side of the fix rack.
Figure 5C:
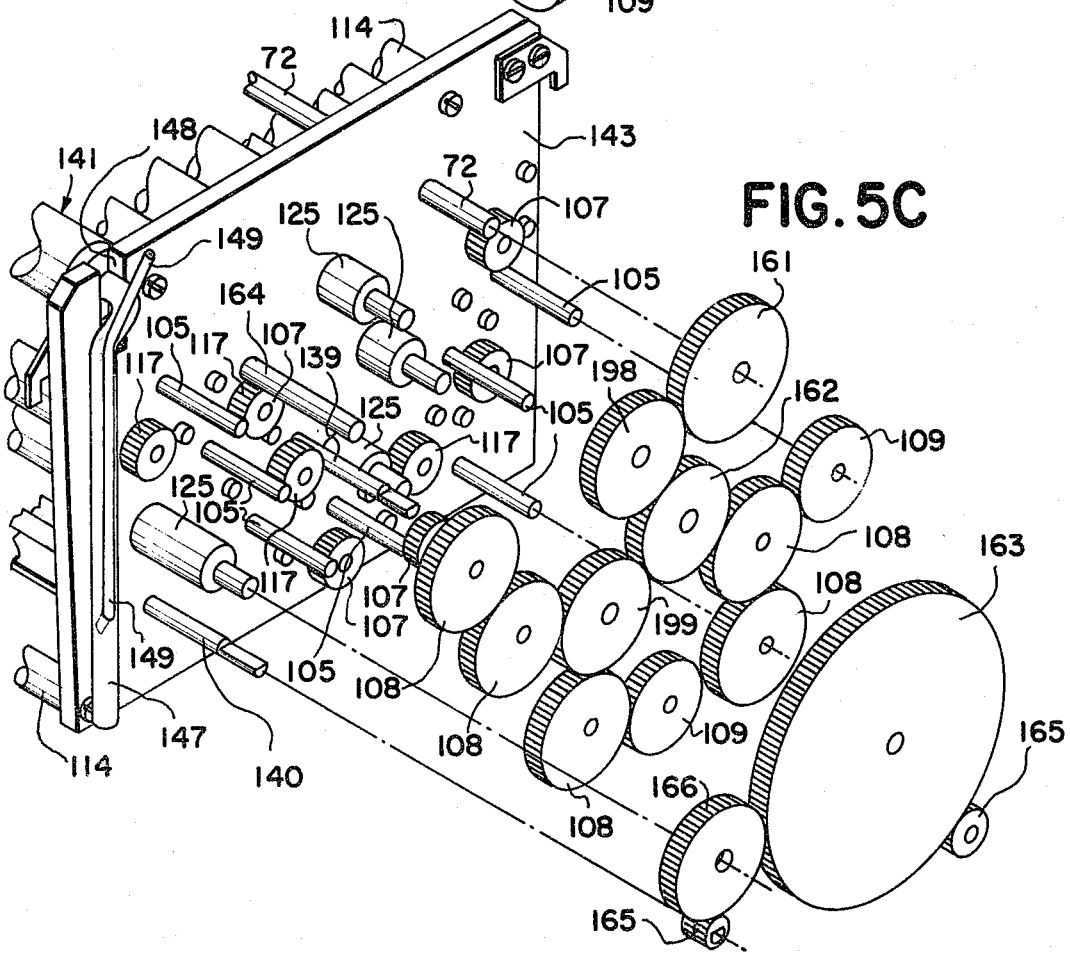
FIG. 5C is an exploded, partial isometric view of the gear drive assembly of the drain side of the fix rack.

FIG. 5B illustrates the gear drive system of the drive side of the fix rack 14. Two groups of intermediate gears 108, 109 are shown; a first group of gears operating the gears of the film accepting region 150 of the rack 14, and a second group of gears operating the gears of the valley region 151 and the film delivering region 152 of the rack 14. As illustrated, three pairs of roller drive gears 107, 117, located at 153, 154 and 155, are not coaxially driven by an intermediate gear, but rather are radially driven by a roller transfer gear 156 which derives power from an adjacent pair of roller drive gears 107, 117.

Each group of intermediate gears 108, 109 derives power from central power gear 157. Central power gear 157 is powered by power gear 158, axially mounted on power input shaft 72, which has axially connected to its end power input gear 75. Power input gear 75 receives power from the power train 55 through worm gear 74 as previously described. Power to operate each group of intermediate gears 108, 109 is thus drawn, as needed, from central power gear 157, in each case by the transfer gears 159 illustrated. Intermediate transfer gear 131 assists in this operation.

Intermediate gears 108, 109 are mounted on the ends of shafts 105 of rollers 103, 104. Transfer gears 131, 159 are retained to the drive side frame 142 of the fix rack 14 by studs 125. Roller transfer gears 156 are retained to the drive side frame 142 of the fix rack 14 by studs 160 which are smaller in size than are studs 125, to accommodate the smaller roller transfer gears 156.

The power input shaft 72 also extends through the fix rack 14 to the drain side of the rack 14, a power gear 161 being axially connected thereto. Power gear 161 in turn operates central power gear 162, through power transfer gear 198, to drive the intermediate gears 108, 109 on the drain side of the fix rack 14.

Two groups of intermediate gears 108, 109 are formed on the drain side; one group operating the rollers 103, 104 of the film accepting region 150 and part of the valley region 151, and the other group operating the rollers 103, 104 of the film delivery region 152 and the remaining portions of the valley region 151. The first described group of gears 108, 109 derives power from the central power gear 162 through transfer gear 199. The second described group of gears 108, 109 derives its power directly from central power gear 162.

Intermediate gears 108, 109 are axially mounted on shafts 105 of rollers 103, 104. Transfer gears 198, 199 are mounted on studs 125 attached to the drain side frame 143.

The fix rack 14 is also provided with vaned stirrers 139, 140 which operate in the manner previously described in conjunction with the developer rack 13. Power is drawn from the power train 55, through bevelled gears 76, 77, and is delivered to stirrer power gear 162 through stirrer drive shaft 164. Stirrer power gear 163 drives an essentially centrally located stirrer 139 through a stirrer drive gear 165, and a second stirrer 140, located beneath the film delivering region 152, through a stirrer drive gear 165 driven by a stirrer transfer gear 166. These gears form a third tier of gears located on the drain side of the rack 14. Stirrers 139, 140 provide a fluid flow within the fix solution located in the fix area 10.

Figures 6, 6A:
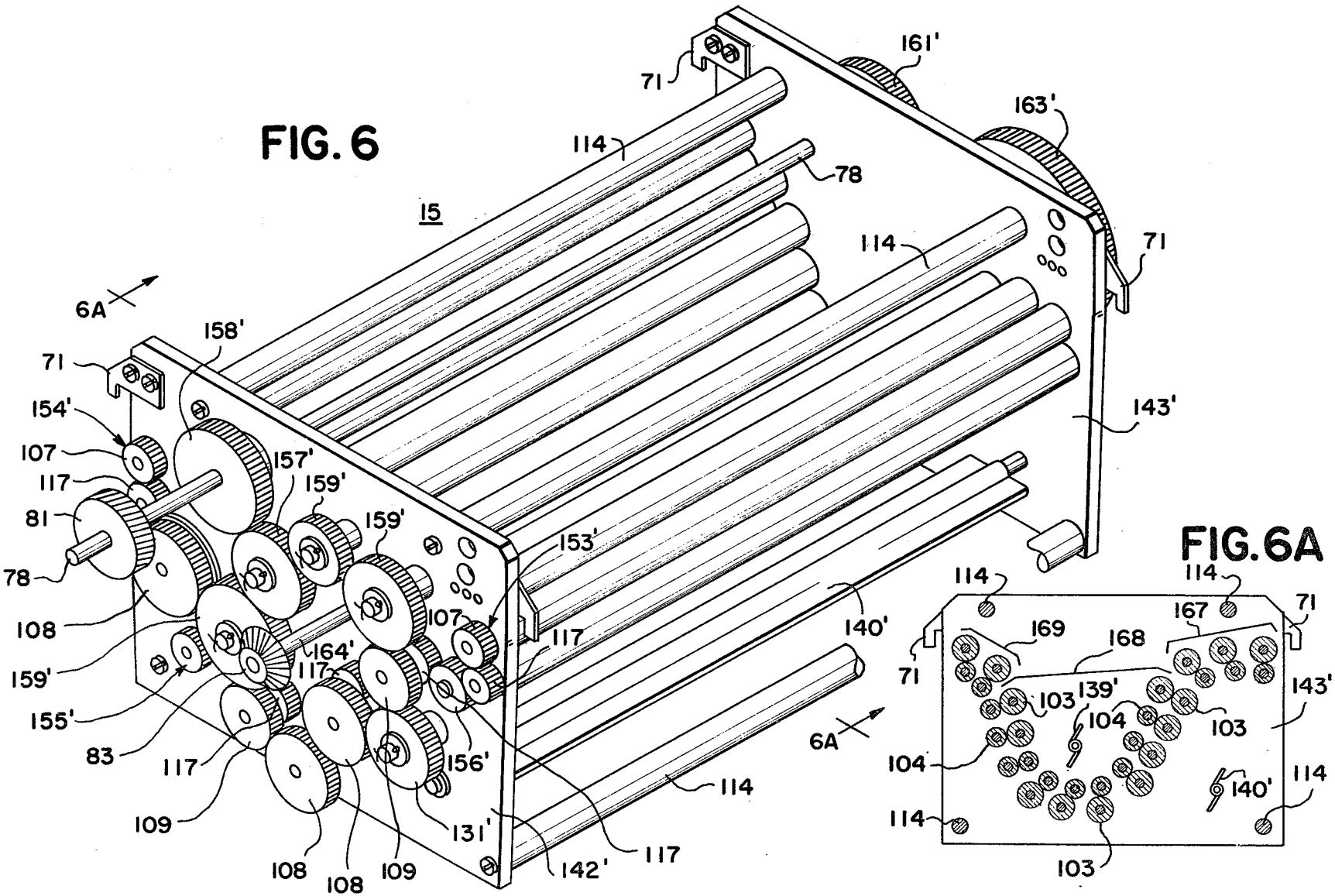
FIG. 6 is an enlarged isometric view of the wash rack illustrated in FIG. 2B.
FIG. 6A is a cross sectional view of the wash rack taken along line 6A—6A of FIG. 6.

FIG. 6 shows the wash rack 15 which is used to transport a film 17 through the wash area 11 after it is received from the fix area 10. FIG. 6A shows the pattern of rollers 103, 104 within the wash rack 15.

The wash rack 15 is essentially similar to the fix rack 14. The rollers and gears which comprise the wash rack 15 are positioned and operate in the same manner as those of the fix rack 14. The only principal difference between the two racks is that the wash rack 15 preferably has no fluid manifold 141 as does the fix rack 14. A similar stirring system is provided.

The roller and gear drive system of the wash rack 15 combines to form a rack having a film accepting region 167, which then directs a film 17 down into the wash solution. The rollers of the wash region 168 then direct the film 17 through the wash solution. After the film 17 is brought back up from the wash region 168 the film is delivered from the rack 15 by the rollers of region 169. The rollers of these regions, as well as the gear systems which power these regions, are operated in the same manner as were the regions 150, 151, 152 of the fix rack 14.

Wash rack 15 draws its power from the power train 55 through power input gear 81, which rotates the power input shaft 78. Operation of the remainder of the gear drive system is as previously described in connection with the fix rack 14, similar reference numbers denoting similar structure.

Figures 7, 7A:
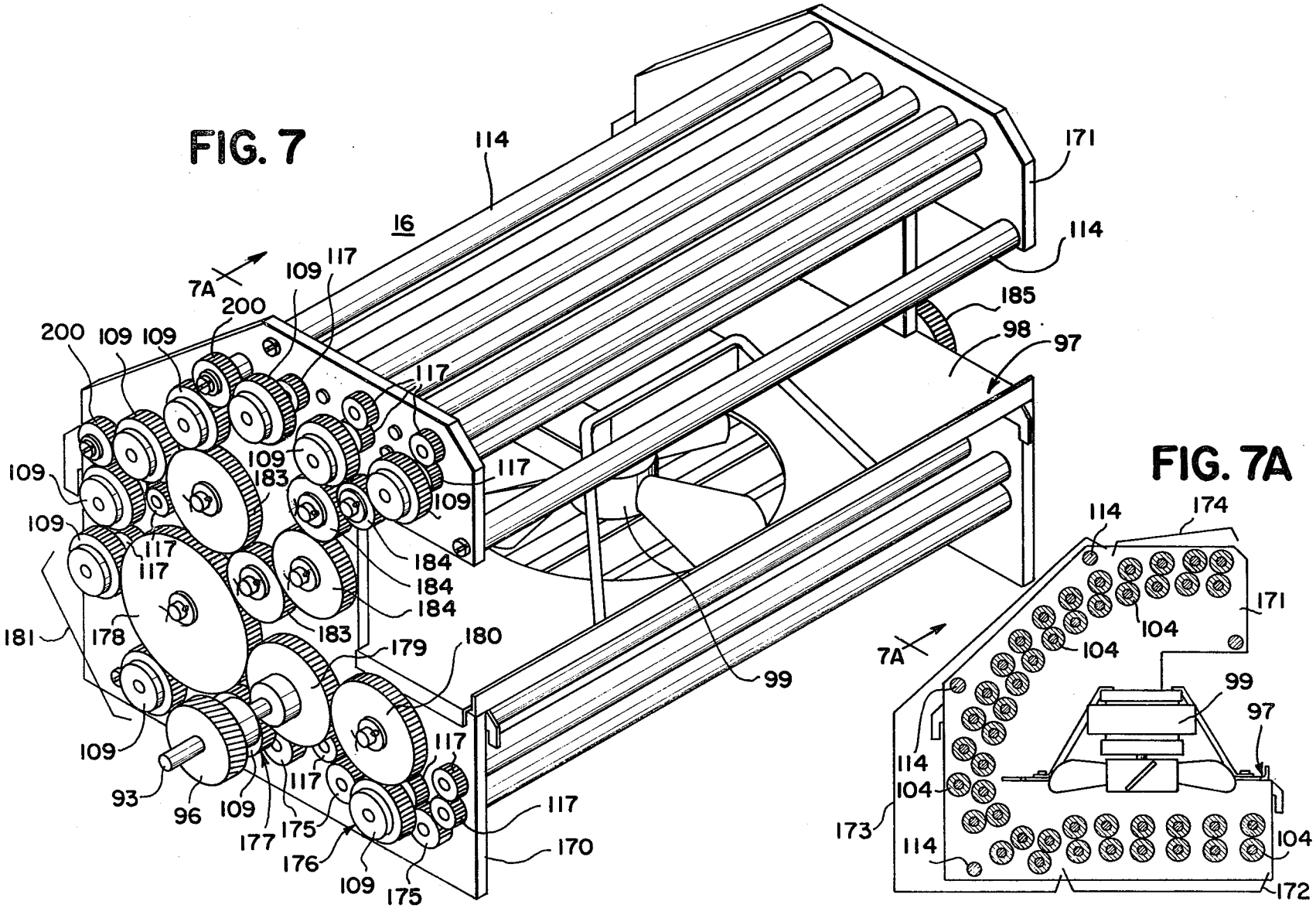
FIG. 7 is an enlarged isometric view of the dryer rack illustrated in FIG. 2B.
FIG. 7A is a cross sectional view of the dryer rack taken along line 7A—7A of FIG. 7.
Figure 7B:
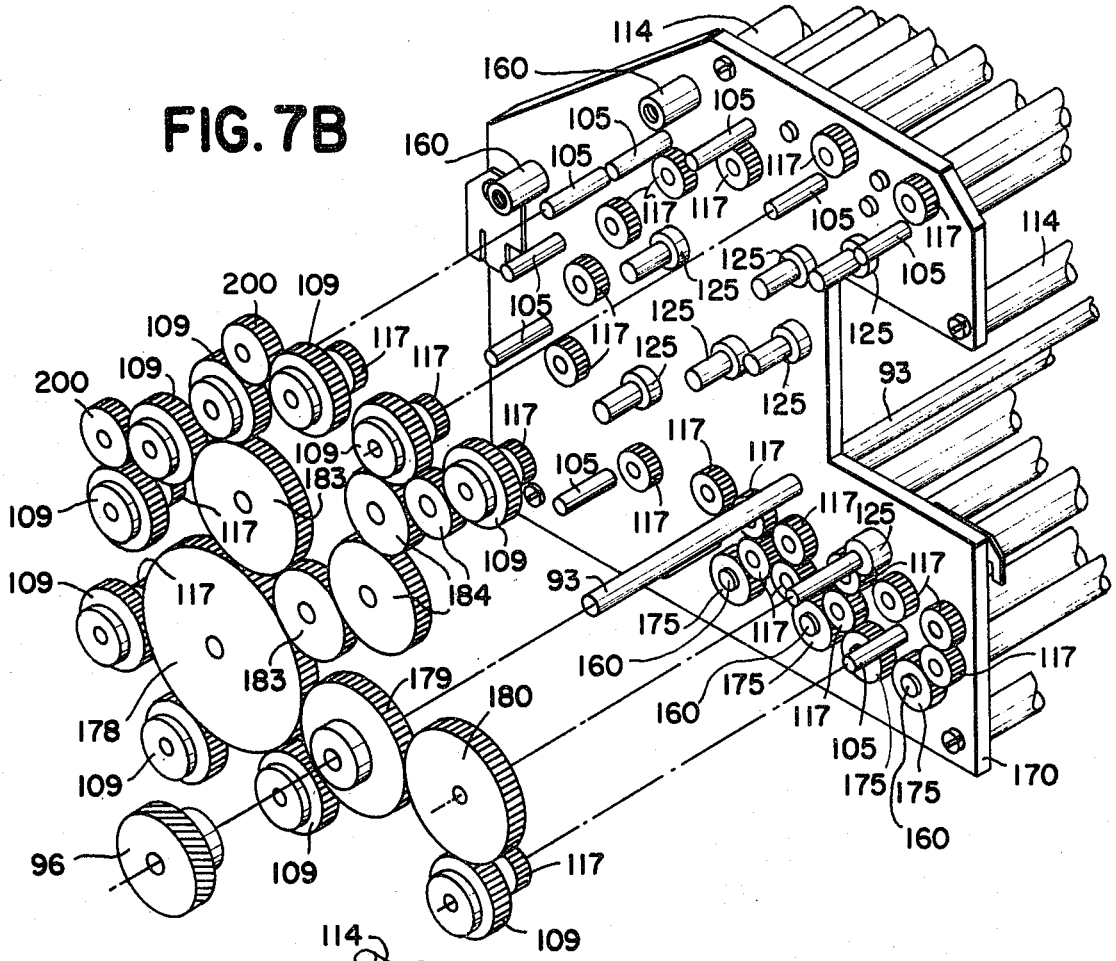
FIG. 7B is an exploded, partial isometric view of the gear drive assembly of the drive side of the dryer rack.
Figure 7C:
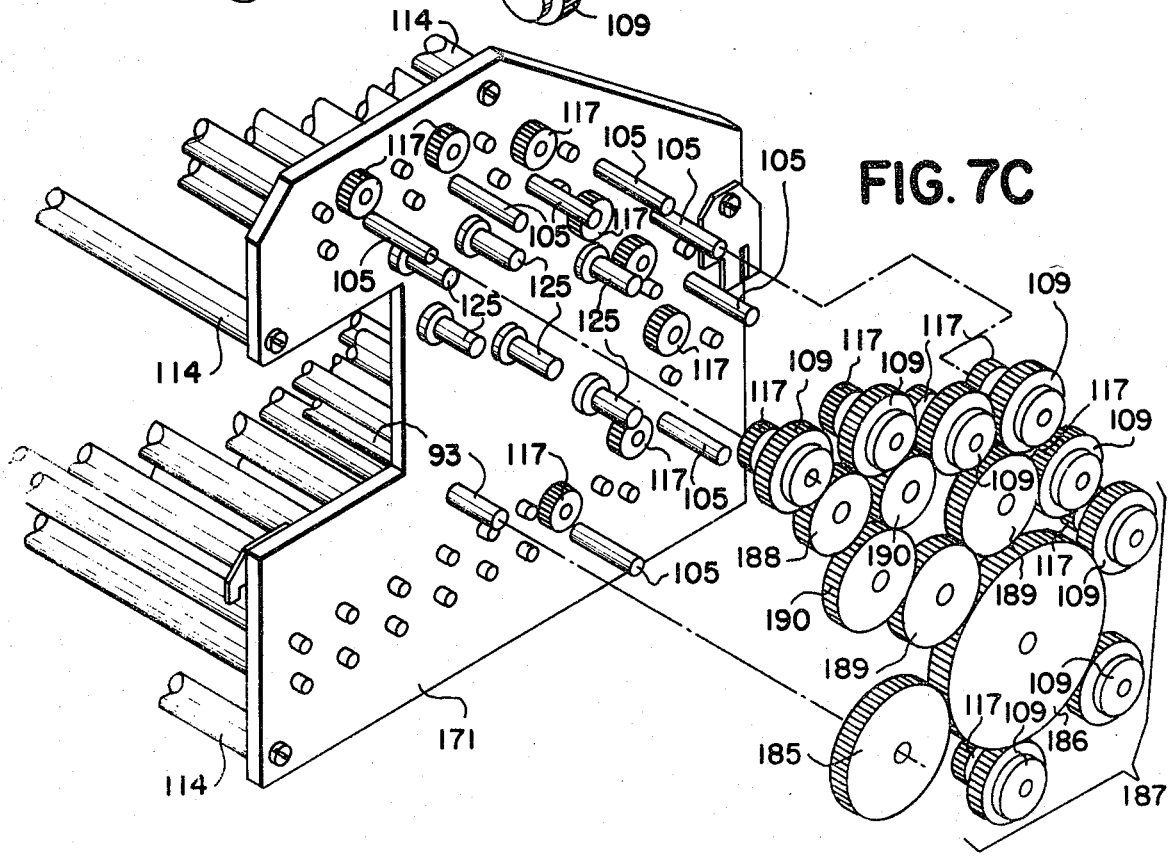
FIG. 7C is an exploded, partial isometric view of the gear drive assembly of the drain side of the dryer rack.

FIG. 7 shows the dryer rack 16 which is used to transport a film 17 through the drying area 12 of the machine 1 after it is received from the wash rack 15. FIGS. 7A, 7B and 7C show construction details of this rack.

The dryer rack 16 generally comprises a plurality of rollers 104 and a fan assembly 97 which extends between a pair of frames 170, 171 which define the sides of the dryer rack 16, the frame 170 defining the drive side of the rack 16, the frame 171 defining the drain side. In the dryer rack 16, all of the rollers 104 are of the smaller diameter to promote drying of a film 17 proceeding therethrough. The fan 99 combines with the lower fan 90, shown in FIG. 3, to provide the air flow required in the drying region 12.

FIG. 7A illustrates the path along which a film 17 is directed as it proceeds through the dryer rack 16. A film 17 is introduced into the rack along an essentially linear drying region 172, where air from the fans 90, 99 is caused to impinge upon the film proceeding therethrough. The film 17 then enters a turnabout region 172 where it is caused to reverse direction and to be raised toward the delivery region 174, where a developed film 28 is delivered from the outlet 7 of the machine 1, as illustrated in FIG. 1.

Drying in the drying area 12 is thereby accomplished in two ways. First, the fans 90, 99 cause warm air to impinge upon a film 17 to be dried. Moreover, the rollers 104 are sufficiently closely spaced together so that air which is caused to impinge upon the rollers 104, and the film 17 being transported therethrough, forms jets of air capable of drying the film 17 as a result of spacing between rollers 104 only. Consequently, no other components, such as baffles, guides or other structure is utilized, either between adjacent rollers 104, or between the rollers 104 and fans 90, 99. Second, a large number of smaller rollers 104 are caused to contact the film 17 as it proceeds through the dryer rack 16. Such contact causes moisture from the film 17 to be picked up by the rollers 104, assisting in the drying process. These rollers 104 are in turn dried by air circulating within the drying region 12.

The gear drive system which drives the above mentioned series of rollers 104, illustrated in FIGS. 7B and 7C, will now be described in greater detail.

Each roller 104 is journalled for rotation within the frames 170, 171, the end of the shaft 105 of each roller 104 being provided with a roller drive gear 117, of small pitch diameter, for operation. Nip forming pairs of rollers 104 are operated by a meshing pair of roller drive gears 117 which cause the rollers 104 to simultaneously rotate in the direction of film travel. To permit close spacing of the rollers 104, pairs of roller drive gears 117 which drive alternating pairs of rollers 104 are positioned on alternating sides of the dryer rack 16. Pairs of roller drive gears 117 are driven by intermediate gears 109, coaxially connected to one gear of the pair of roller drive gears 117. These intermediate gears 109 are positioned to mesh and form groups of gears 109, each of which is capable of tapping the amount of power required for operation of the gears associated with that group of gears from the power gears as follows.

FIG. 7B shows the gear drive assembly associated with the drive side of the dryer rack 16.

A first group of gears operates the rollers 104 forming the drying region 172 of the dryer rack 16. In that group, intermediate gears 109, at 176 and 177, combine to drive the rollers 104 of the drying region 172. Intermediate gear 109, at 177, is driven by central power gear 178, which is in turn operated by power gear 179. Intermediate gear 109, at 176, is driven by power gear 179, through transfer gear 180. Other rollers 104 in the drying region 172 are driven by roller transfer gears 175 which mesh with adjacent roller drive gears 117 as illustrated.

A next group of intermediate gears 109, at 181, operate the rollers 104 located at the beginning of the turnabout region 173. These gears draw power directly from the central power gear 178.

Two groups of intermediate gears 117 are then driven from the central power gear 178. A first group of intermediate geas 117 drives the remainder of the drive side rollers 104 that comprise the turnabout region 172 through transfer gears 183 and intermediate transfer gears 200. A second group of gears operate the drive side rollers 104 associated with the film delivering region 174 through additional transfer gears 184. As with the previously described racks, the intermediate gears 109 are mounted on the ends of the shafts 105 of rollers 104, while the transfer gears 175, 180, 183, 184, 200 are mounted on studs 125, 160 attached to the drive side frame 170.

The above mentioned groups of gears all draw power from the power train 55 through power input gear 96, which rotates power input shaft 93. Axially connected to power input shaft 93 is power gear 179 which operates the central power gear 178 of the drive side of the dryer rack 16.

Power input shaft 93 also extends through the dryer rack 16 to operate the gear drive system located on the drain side of the dryer rack 16, illustrated in FIG. 7C. Connected to the end of the power input shaft 93 is a power gear 185 which in turn rotates the central power gear 186 on the drain side of the dryer rack 16.

A group of intermediate gears 109, shown at 187, is driven directly by the central power gear 186. This group of intermediate gears 109 drives those rollers 104 associated with the turnabout region 173 of the dryer rack 16 which are driven by roller drive gears 117 positioned on the drain side of the dryer rack 16.

Two groups of intermediate gears 109 are then driven by the central power gear 186. A first group of intermediate gears 109, driven through transfer gears 189, operates rollers 104 of the turnabout region 172. A second group of intermediate gears 109, driven through additional transfer gears 109 and intermediate transfer gear 188, operates rollers 104 of the film delivering region 174.

Intermediate gears 109 are connected to the ends of the shafts 105 of the rollers 104 which they cause to rotate. Transfer gears 188, 189, 190 are mounted on studs 125 affixed to the drain side frame 171.

Each of the above described roller racks 13, 14, 15, 16 operate smoothly and reliably to transport a film 17 through the several areas of the film development machine 1. Although the rollers 103, 104 are spaced closely together, permitting small films to reliably proceed therethrough, the above described gear drive systems operate in a manner which permits such rollers 103, 104 to be driven utilizing a completely geared drive system.

As is apparent from the description of operation of each of the roller racks 13, 14, 15, 16, each rack must permit the circulation of a fluid (liquid or air) between the interior portions of each rack and its exterior portions. Although such a fluid may pass through the rollers 103, 104 in each of the racks above described, it is also possible to provide in each rack additional openings or borings, which extend through the frames 112, 113, 142, 143, 142', 143', 170, 171 of the racks 13, 14, 15, 16 respectively, if desired, to improve fluid flow through each rack and the area in which it is located.

It may therefore be seen that the above disclosed invention serves well to accomplish the objects previously stated. It may also be seen that the above described invention may be embodied in other specific forms in addition to those above disclosed and therefore the disclosure made should be interpreted in an illustrative and not a limiting sense.

We claim:

1. In a transport roller rack, operated by power gears to transport a film through one of a plurality of treatment tanks capable of containing a plurality of fluids therein for the development of the film, the roller rack having a plurality of nip forming pairs of rollers, each pair of rollers being coaxially rotated by a pair of intermeshing roller drive gears, different ones of said pairs of intermeshing roller drive gears being disposed alternately on opposite sides of the roller rack, a geared roller drive system comprising first gears which coaxially rotate one of the gears of the pairs of roller drive gears, second gears, serially rotated by the power gears, which serially rotate a multiplicity of the first gears, portions of the path along which the film travels being curved, and the rollers which define the curved portions of the path of film travel being of two diameters, those rollers which are larger in diameter generally forming the convex side of the curved portions in the path of film travel, and those rollers which are smaller in diameter generally forming the concave side of the curved portion in the path of film travel.

2. The roller rack of claim 1 wherein the rollers are driven by roller drive gears of two pitch diameters, those rollers of greater diameter being driven by roller drive gears of greater pitch diameter, and those rollers of smaller diameter being driven by roller drive gears of smaller pitch diameter.

3. The roller rack of claim 2 wherein the roller drive gears are driven by first gears of two pitch diameters, those roller drive gears having the greater pitch diameter being driven by first gears of greater pitch diameter, and those roller drive gears having the smaller pitch diameter being driven by first gears of smaller pitch diameter.

4. The roller rack of claim 3 wherein the diameters of the rollers of smaller diameter and the pitch diameter of the roller drive gears and first gears of smaller pitch diameter, are proportioned with respect to the diameters of the rollers of greater diameter and the pitch diameters of the roller drive gears and first gears of greater pitch diameter, so that the rollers in each roller rack have the same surface speed.

5. The roller rack of claim 1 wherein the rollers of the roller rack form a curved path of film travel which causes the film to enter the rack and to leave the rack, from the same side of that rack, in opposite directions, and in planes which are parallel to each other.

6. The roller rack of claim 5 wherein the roller rack is capable of drying the film being transported therethrough.

7. The roller rack of claim 6 wherein a roller rack is located within each of the other of the plurality of treatment tanks, and wherein the dryer rack is substantially raised from the other roller racks.

8. The roller rack of claim 7 wherein the point that the film is introduced into the dryer rack lies in a plane substantially parallel with the plane defined by the point of exit of the film from the other roller racks.

9. The roller rack of claim 8 wherein all of the roller racks except the dryer rack have rollers having two different diameters, and the dryer rack has rollers which are all of the same diameter.

10. The roller rack of claim 9 wherein the rollers of the dryer rack are equivalent in diameter to those rollers in the other roller racks which are smaller in diameter.

11. The roller rack of claim 10 further comprising a fan positioned over the rollers, which produces air which impinges upon the rollers and the film.

12. The roller rack of claim 11 wherein the space between the fan and the rollers is essentially free of structural components.

13. The roller rack of claim 10 having a pair of fans positioned over the rollers and on opposite sides of the path of film travel, which produce air which impinges upon the rollers and the film.

* * * * *